US012624607B2

(12) United States Patent
Craig et al.

(10) Patent No.: US 12,624,607 B2
(45) Date of Patent: May 12, 2026

(54) TUBING HANGER RE-ENTRY TOOL

(71) Applicant: Baker Hughes Energy Technology UK Limited, Bristol (GB)

(72) Inventors: Brian Craig, Aberdeen (GB); Malcolm David Finlayson, Aberdeen (GB); Michael Donnelly, Aberdeen (GB); Timothy Crowther, Brechin (GB); Andrew Hughes, Aberdeen (GB)

(73) Assignee: Baker Hughes Energy Technology UK Limited, Bristol (GB)

( * ) Notice: Subject to any disclaimer, the term of this patent is extended or adjusted under 35 U.S.C. 154(b) by 0 days.

(21) Appl. No.: 18/803,338

(22) Filed: Aug. 13, 2024

(65) Prior Publication Data

US 2025/0059846 A1 Feb. 20, 2025

Related U.S. Application Data

(60) Provisional application No. 63/532,845, filed on Aug. 15, 2023.

(51) Int. Cl.
*E21B 33/04* (2006.01)
*E21B 47/06* (2012.01)

(52) U.S. Cl.
CPC ..... *E21B 33/04* (2013.01); *E21B 47/06* (2013.01)

(58) Field of Classification Search
CPC ..... E21B 33/00; E21B 33/02; E21B 33/03; E21B 33/035; E21B 33/038; E21B 33/04; E21B 33/043; E21B 47/06
See application file for complete search history.

(56) References Cited

U.S. PATENT DOCUMENTS 3,468,559 A 9/1969 Ahlstone
3,543,847 A 12/1970 Haeber
3,688,841 A 9/1972 Baugh
3,693,714 A 9/1972 Baugh
4,067,062 A 1/1978 Baugh
4,167,215 A * 9/1979 Thorne ..... E21B 41/0014 166/341

(Continued)

FOREIGN PATENT DOCUMENTS

AU 2014405556 B2 11/2017
BR 112016010887 B1 6/2021

(Continued)

OTHER PUBLICATIONS

International Search Report and Written Opinion issued in PCT Application No. PCT/EP2024/025246, completed Nov. 4, 2024, being mailed Nov. 15, 2024 (11 pages).

(Continued)

*Primary Examiner* — Brad Harcourt
(74) *Attorney, Agent, or Firm* — Hogan Lovells US LLP

(57) ABSTRACT

In at least one embodiment, a system for a re-entry tool to be used with oilfield equipment is disclosed. A stinger that includes flushing holes to enable fluid for flushing through the re-entry tool and into one or more of an Xmas tree head, tubing hanger, or crown plug, is provided in the system. The system includes one or more sleeves external to the stringer. The one or more sleeves include flushing slots to enable circulation of the fluid from the Xmas tree head, tubing hanger, or crown plug to an external environment relative to the Xmas tree head.

18 Claims, 11 Drawing Sheets

(56) References Cited

U.S. PATENT DOCUMENTS

| | | | | |
|---|---|---|---|---|
| 5,462,119 | A | 10/1995 | de Souza et al. | |
| 5,868,203 | A | 2/1999 | Cunningham | |
| 6,453,996 | B1 * | 9/2002 | Carmichael | E21B 37/00 166/222 |
| 6,725,924 | B2 | 4/2004 | Davidson et al. | |
| 6,763,891 | B2 | 7/2004 | Humphrey et al. | |
| 7,025,132 | B2 | 4/2006 | Kent et al. | |
| 7,513,308 | B2 | 4/2009 | Hosie et al. | |
| 8,127,853 | B2 | 3/2012 | Pallini et al. | |
| 8,276,689 | B2 | 10/2012 | Giroux et al. | |
| 8,752,651 | B2 | 6/2014 | Randall et al. | |
| 9,540,894 | B2 | 1/2017 | June et al. | |
| 10,669,792 | B2 | 6/2020 | Nguyen | |
| 10,907,447 | B2 | 2/2021 | Stang et al. | |
| 11,174,709 | B2 | 11/2021 | Steele et al. | |
| 2004/0163818 | A1 | 8/2004 | Fenton et al. | |
| 2005/0217845 | A1 | 10/2005 | McGuire | |
| 2008/0017384 | A1 * | 1/2008 | Anderson | E21B 33/035 166/347 |
| 2014/0182858 | A1 | 7/2014 | Fenton | |
| 2024/0401474 | A1 * | 12/2024 | Mason | E21B 33/035 |

FOREIGN PATENT DOCUMENTS

| | | | |
|---|---|---|---|
| CA | 2748994 | C | 11/2013 |
| EP | 0405734 | A2 | 1/1991 |
| EP | 0421037 | A1 | 4/1991 |
| EP | 0520744 | A1 | 12/1992 |
| EP | 0405734 | B1 | 7/1995 |
| EP | 1664479 | B1 | 6/2010 |
| EP | 2321491 | B1 | 4/2013 |

OTHER PUBLICATIONS

Lienau, "Hanger Running Tool", Abstract, Technical Disclosure Commons, https://www.tdcommons.org/dpubs_series/4568, Sep. 2021, 1 page.

Lienau, "Method for Installing A Hanger", Abstract, Technical Disclosure Commons, https://www.tdcommons.org/dpubs_series/4569, Sep. 2021, 1 page.

* cited by examiner

TUBING HANGER RE-ENTRY TOOL

CROSS-REFERENCE TO RELATED APPLICATION

This Non-Provisional Application claims the benefit of priority to U.S. Provisional Application No. 63/532,845, titled "TUBING HANGER RE-ENTRY TOOL," filed Aug. 15, 2023, the entire contents of which is incorporated by reference herein for all intents and purposes.

BACKGROUND

1. Technical Field

This disclosure relates generally to oilfield equipment and more particularly to systems and methods for a well re-entry tool to be used with oilfield equipment.

2. Description of the Prior Art

Oilfield equipment may include a tubing hanger re-entry tool to provide access and service, such as wireline services, coil tubing, or fluid intervention for a tubing hanger or other assembly in a wellhead or horizontal tree. A tubing hanger is a device which is attached to the topmost tubing joint in the wellhead to support the tubing string in the oilfield equipment. The tubing hanger typically is located in the horizontal tree, tubing head, or wellhead, with components incorporating a sealing system to ensure that the tubing conduit and annulus are hydraulically isolated. A tubing hanger re-entry tool can enable removal and replacement of a tubing hanger and production tubing (or other tubing) from an associated horizontal tree, tubing head, or wellhead. A tubing hanger re-entry tool can engage with the tubing hanger. Upon engagement, the tubing hanger re-entry tool may be used to remove or to replace downhole completion components including isolation barrier valves replaces traditional wireline plugs. However, debris may build-up over time which can impact access to the well interface latching profile.

SUMMARY

In at least one embodiment, a system for a re-entry tool to be used with oilfield equipment is disclosed. A stinger that includes flushing holes to enable fluid for flushing through the re-entry tool and into one or more of an Xmas tree head, tubing hanger, or crown plug, is provided in the system. The system includes one or more sleeves external to the stringer. The one or more sleeves include flushing slots to enable circulation of the fluid from the Xmas tree head, tubing hanger, or crown plug to an external environment relative to the Xmas tree head.

In at least one embodiment, a method for a re-entry tool to be used with oilfield equipment is disclosed. The method includes providing a stinger that has flushing holes within the re-entry tool. The method also includes enabling fluid for flushing through the stinger and into one or more of an Xmas tree head, tubing hanger, or crown plug. Further, the method includes enabling one or more sleeves that are external to the stringer and that have flushing slots to circulate the fluid from the Xmas tree head, tubing hanger, or crown plug to an external environment relative to the Xmas tree head.

BRIEF DESCRIPTION OF DRAWINGS

Some of the features and benefits of the present disclosure having been stated, others will become apparent as the description proceeds when taken in conjunction with the accompanying drawings, in which.

Figure 1:
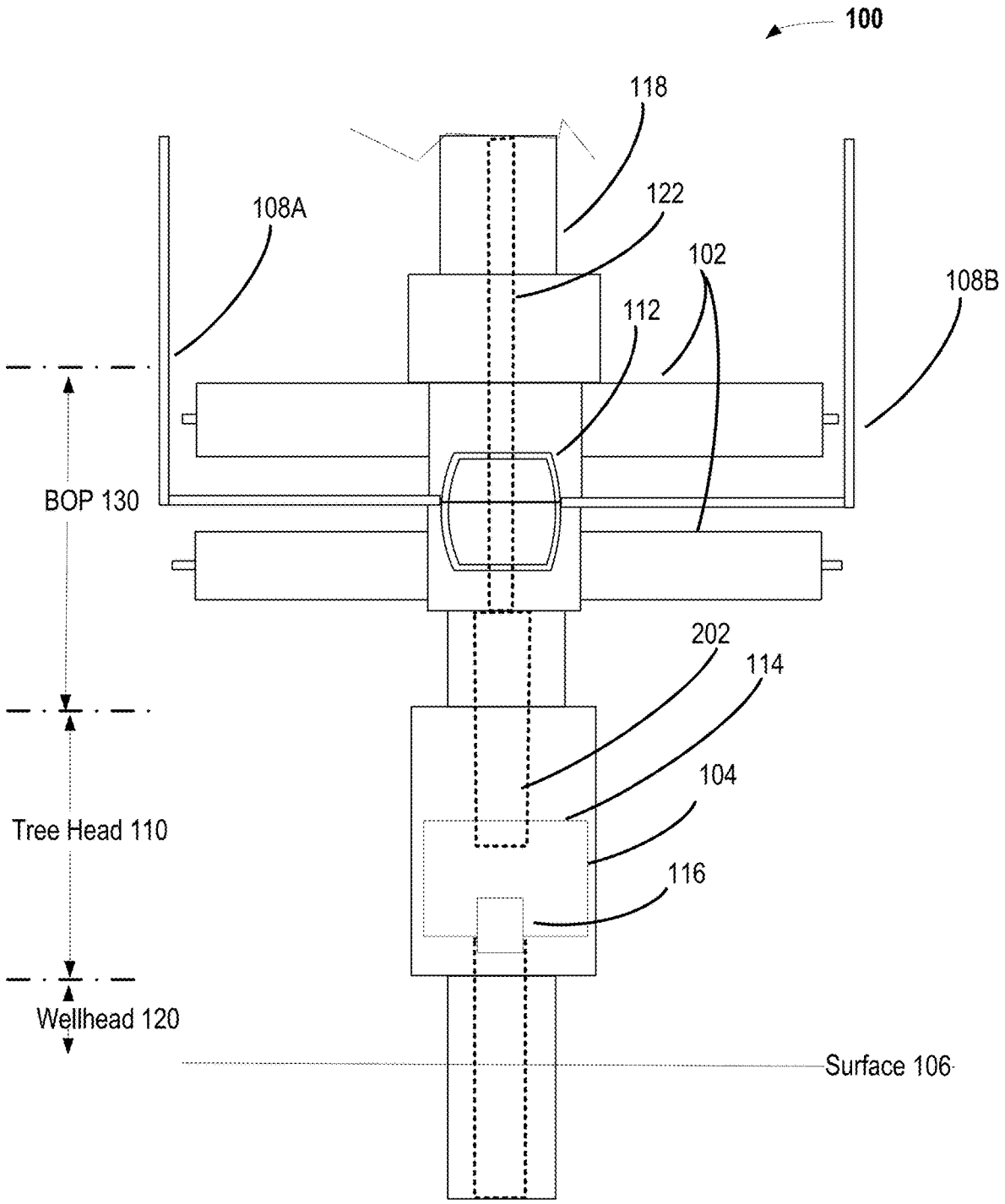
FIG. 1 is a block diagram of certain oilfield equipment that is subject to a system for well control which can facilitate a re-entry tool, as detailed herein and in accordance with at least one embodiment.

While the disclosure will be described in connection with the preferred embodiments, it will be understood that it is not intended to limit the disclosure to that embodiment. On the contrary, it is intended to cover all alternatives, modifications, and equivalents, as may be included within the spirit and scope of the disclosure as defined by the appended claims.

DETAILED DESCRIPTION

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

In at least one embodiment, a system for a re-entry tool ensures that debris can be sufficiently flushed from the latching profile to enable the tool to latch onto the tubing hanger enabling access to the completion tubing. For instance, to resolve issues described above, a system for a re-entry tool to be used with oilfield equipment is disclosed. A stinger that includes flushing holes to enable fluid for flushing of debris through the re-entry tool and into one or more of an Xmas tree head, tubing hanger, or crown plug, is provided in the system. The system includes one or more sleeves external to the stringer. The one or more sleeves include flushing slots to enable circulation of the fluid and debris from the Xmas tree head, tubing hanger, or crown plug to an external environment relative to the Xmas tree head. For instance, the fluid and debris can be returned, as part of the circulation, to the external environment where the returned fluid can be monitored for cleanliness.

In at least one embodiment, the re-entry tool may be used with a tubing hanger of an Xmas tree head that has an ability to tolerate a level of debris on top of the tubing hanger. The re-entry tool has capability to flush out the debris prior to landing the re-entry tool in the Xmas tree head. Further, the re-entry tool can facilitate well-intervention runs and well-kill, along with a capability to retrieve the tubing hanger. In at least one embodiment, the re-entry tool may be locked into an Xmas tree head at its internal profile. The re-entry tool may be sealed or affixed to the tubing hanger, temporarily to remove debris over the tubing hanger.

The re-entry tool can reduce non-productive time on well re-entry by circulating returned fluid and debris from the latching profile of the tubing hanger during re-entry scopes, where rigs may have otherwise experienced up to multiple days of non-productive down time due to failed attempts to land and to lock with other running tools that do not have flushing capability. The re-entry tool can lock into the Xmas tree head but not lock onto the tubing hanger latching profile. Instead, the re-entry tool has flushing ports therein to permit removal of debris, including mud and silt on top of the tubing hanger, such as on top of the latching profile.

Well re-entry for deep wells may be challenging to engage a latching profile of at the top of the tubing hanger due to debris. The latching profile is an interface that may be compromised due to debris and may make it difficult to perform latching connections there to. For example, silt and dirt may sit on top of the tubing hanger, at the latching profile. A Universal Running Tool (URT) may not be able to flush such debris or other tools may perform fully flush such debris resulting in a need for down time for manual or robotic flushing.

In at least one embodiment, a re-entry tool is part of a system including the Xmas tree head that can flush and circulate out dirt and other debris from the latching profile or the top of the tubing hanger with ports in the re-entry tool and holes in a sleeve of the re-entry tool to allow the debris to be circulated from the latching profile or crown plug of the tubing hanger within the Xmas tree head. This is so that a seal sub can be made up to a seal pocket of the tubing hanger and so that the area around a lock sleave of the tubing hanger is flushed clear. The re-entry tool can function to lock into an internal profile of an Xmas tree head with a high-integrity lock. The tubing hanger is already locked into the Xmas tree head at a lower locking part of the internal profile. As such, the re-entry tool enables a conduit for pressure retention and for force resistance between the tubing hanger, such as at a landing string, and the rig.

In at least one embodiment, the re-entry tool includes a reduced outer diameter to aid the flushing operation. A secondary unlock is enabled by an outer latch in an extended position to cause one or more dogs to engage an inner profile of the Xmas tree head. One or more slots are provided through one or more sleeves of the re-entry tool to improve the flushing operation, such as to allow fluid to be returned to an external environment with debris collected from the Xmas tree head. Further, the re-entry tool includes a stinger that is interchangeable. The one or more sleeves may include a reducer sleeve to suit different diameter Xmas tree heads. Further, the stinger is retractable and has flushing holes to enable part of the flushing operation. Still further, in at least one embodiment, one or more orientation keys of the re-entry tool enable alignment of each of the one or more sleeves with respect to each other and with respect to the stinger within the re-entry tool.

FIG. 1 is a block diagram of oilfield equipment 100 that is subject to well control which can facilitate a re-entry tool 202 having a stinger with flushing holes and one or more sleeves with flushing ports, as detailed herein and in accordance with at least one embodiment. The oilfield equipment 100 may include a tree head 110 over a wellhead 120 located at or about a surface layer 106. The tree head 110 may include a tubing hanger 104 having a top profile 114 and having a plug 116. In at least one embodiment, even though illustrated with a tree head 110, certain operations including well-intervention runs, well-kill, and retrieval of the tubing hanger may be performed without aspects of the tree head 130. Further, the plug 116 may be pulled into the tubing hanger 104 before performing the landing of the re-entry tool 202 and before performing the flushing herein.

A blowout preventer (BOP) 130 provides prevention, pressure-related controls, as well as other functions in the oilfield equipment 100. The BOP 130 include seals that may be used for injectables, as well as pipe rams, shear rams, fluid rams, and other features to prevent any improper release of well fluids. There may be a ported slick joint having a cavity 112 disposed between one or more of the rams 102 of the BOP 130. Further, the cavity 112 may be associated with choke and kill lines 108A, 108B. There may be a further emergency BOP above the illustrated BOP 130. The emergency BOP may provide pressure control during a completion for running a re-entry tool 202.

In at least one embodiment, there may be one or more umbilical associated with the re-entry tool 106, such as within a riser 118 or along a landing string. An umbilical may support fluid removal or delivery, control, or communication to a surface outside the oilfield equipment 110. In at least one embodiment, however, the re-entry tool 202 allows fluid and debris to be returned from a profile 114 or other areas associated with the tubing hanger 104, and to the cavity 112. Then, the choke and kill lines 108A, 108B may be used to remove the fluid and debris to the surface that is outside the oilfield equipment 100. For example, the fluid and debris may be pumped into the cavity 112 of a ported slick joint, where the cavity is above the re-entry tool 202 may be above the ported slick joint. The fluid and debris may be further pumped up via at least the kill line 108A, which may be supported by a limited flow—by of a retainer valve.

In an example, one or more of the rams 102 of the BOP 130 may be closed around a casing associated with the riser 118 to enable the fluid and debris to the removed via the choke and kill lines 108A, 108B. In at least one embodiment, the tree head 110 may be exposed to the elements without aspects of an Xmas tree. Therefore, the tree head 110 may requiring flushing, at least as to the tubing hanger 104 and areas associated there with, prior to the re-entry tool 202 being used to operations supported there with. In at least one embodiment, a kill line 108A that is used for removal of the fluid and debris is a lower-most kill line 108A, but an umbilical that is outer to the landing string 122 may be also used for the removal of the fluid and debris. Further, a cavity 112 may be associated with the ported slick joint at a lower-most ram of the BOP 130. The landing string 122 may have a constriction or restrictive outer diameter to enable flow—by. In different embodiments, a crossover flange at a top of the re-entry tool 202 may be such that it is located below the cavity 112, at a level of a ram 102 of the BOP 130 or between one or more rams 102 of the BOP 130.

Figure 2:
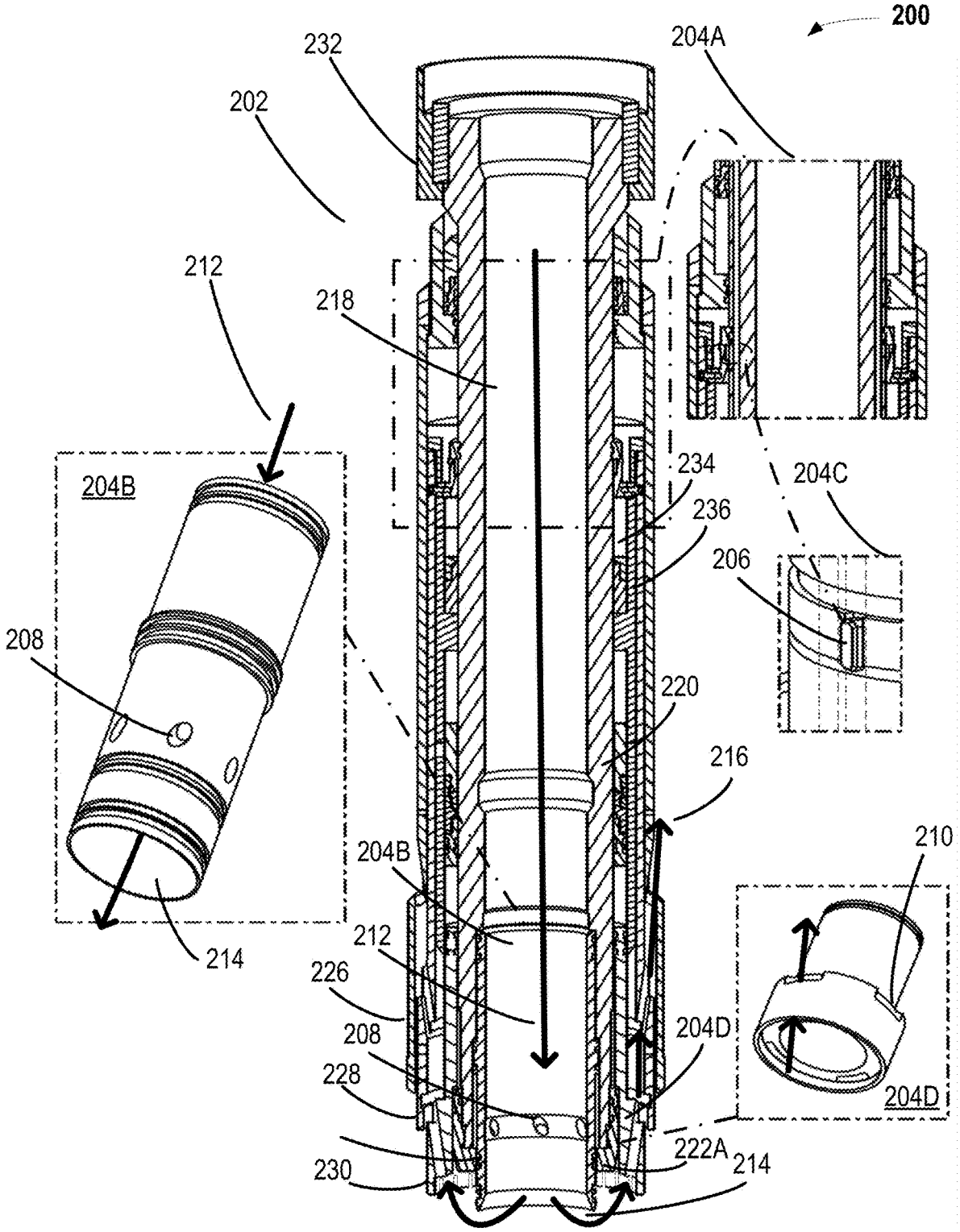
FIG. 2 is a further detailed cross-sectional view of aspects of a system for a re-entry tool along with excerpts of specific features associated there with, in accordance with at least one embodiment.

FIG. 2 is a detailed cross-sectional view of aspects 200 of a system for a re-entry tool 202 along with excerpts of specific features associated there with, in accordance with at least one embodiment. In at least one embodiment, the re-entry tool 202 includes a reduced outer diameter of a crossover adapter 232 to aid the flushing operation. The crossover adapter 232 may include an integral junk trap. The re-entry tool 202 includes a stinger 204B having one or more flushing holes 208 to enable flushing there through.

In at least one embodiment, the re-entry tool 202 includes one or more sleeves, such as a latch piston 204D (also referred to herein as a latch dog piston). The latch piston 204D is a sleeve comprising one or more flushing slots 210 to enable flushing there through. In at least one embodiment, fluid flows 212 through an inner portion 218 of the re-entry tool 202, through the stinger 204B, and out of a bottom 214 of the stinger 204B. In at least one embodiment, based in part on the stinger being extended or retracted, the fluid may be allowed or disallowed to flow through the one or more flushing holes 208. The fluid may pick up any debris from the Xmas tree head 110 and may provide it to an external environment 216, relative to the Xmas tree head 110. In at least one embodiment, the external environment 216, relative to the Xmas tree head 110, is, at least initially, a cavity 112 of a ported slick joint from where one or more of the choke and kill lines 108A, 108B are engaged to remove the fluid and debris. In at least one embodiment, the pumping action is for the entry of the fluid for flushing, through a landing string 118, but that is sufficient to cause the debris and removal fluid to flow through the cavity 112 of the ported slick joint, through at least the kill line 108A, and to an environment external to the tree head 110.

In at least one embodiment, the one or more sleeves also include a soft landing sleeve 226 and a latch dog support sleeve 228. The one or more sleeves are all external to the stringer 204B. Further, the one or more sleeves may each include the flushing slots, as illustrated with respect to the flushing slots 210 of the latch piston 204D. The flushing slots 210 enable return of the fluid from the Xmas tree head 110 to an external environment 216, relative to the Xmas tree head 110. In at least one embodiment, FIG. 2 also illustrates that one or more orientation keys 206 (such as, in excerpt 204C) may be provided in the one or more sleeves of the re-entry tool 202. The orientation keys allow one sleeve to interface with another sleeve in an intended orientation and allows the one or more sleeves to remain interfaced with each other during operation.

Figure 3:
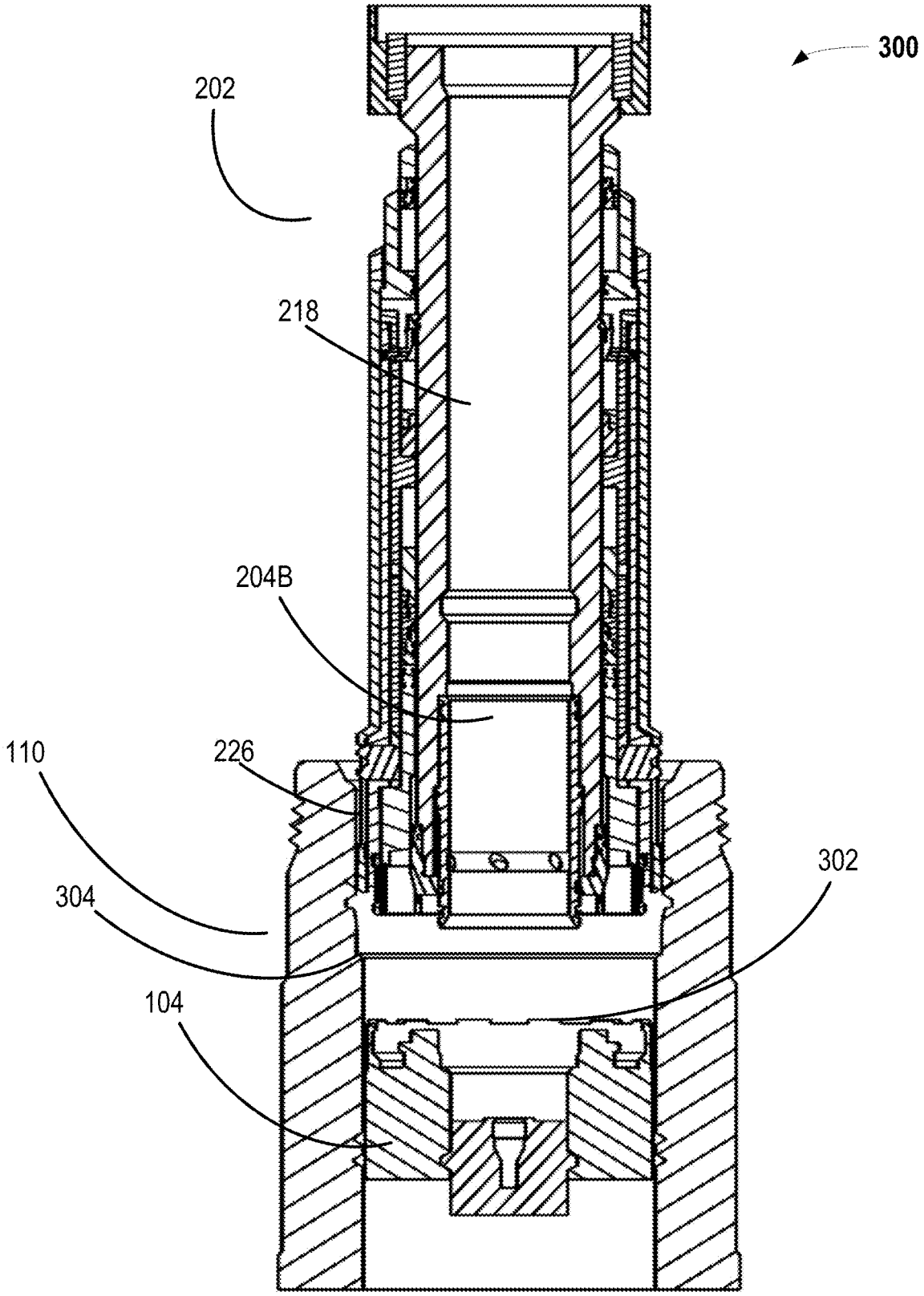
FIG. 3 is a cross-sectional view of aspects of a system for a re-entry tool along with Xmas tree head features associated there with, in accordance with at least one embodiment.

In at least one embodiment, latch dogs 230 may be provided as an independent feature or as one of the one or more sleeves. The latch dogs 230 enable latching of the re-entry tool 202 with the latching profile 302 (in FIG. 3) of a tubing hanger 104 or of the Xmas tree head 110. In at least one embodiment, as the stinger 204B is subject to wear from the flushing operation, it is interchangeable within the re-entry tool 202. Further, the one or more sleeves of the re-entry tool 202 may include a reducer sleeve to suit different diameter Xmas tree heads. This may be allowed by the use appropriate sleeves, including at least an appropriate soft landing sleeve 226, latch dog support sleeve 228, latch piston 204D, and a crossover adapter 232. A stinger retainer cap 222 is provided to retain the stinger 204B in a retracted position using retainer tabs FIG. 3 is a cross-sectional view of aspects 300 of a system for a re-entry tool 202 along with an Xmas tree head 110 associated there with, in accordance with at least one embodiment. The aspects 300 also illustrate a first step of the use of a system for a re-entry tool 202 with the Xmas tree head 110. In the first step, a run-in-hole (RIH) operation persists with the re-entry tool 202 being lowered into the Xmas tree head 110. The RIH operation also persists while flushing is performed prior to the re-entry tool 202 being landed on a shoulder 304 of the Xmas tree head 110. As also illustrated in FIG. 3, the stinger 204B is illustrated as being in a retracted position within the re-entry tool 202.

Figure 4A:
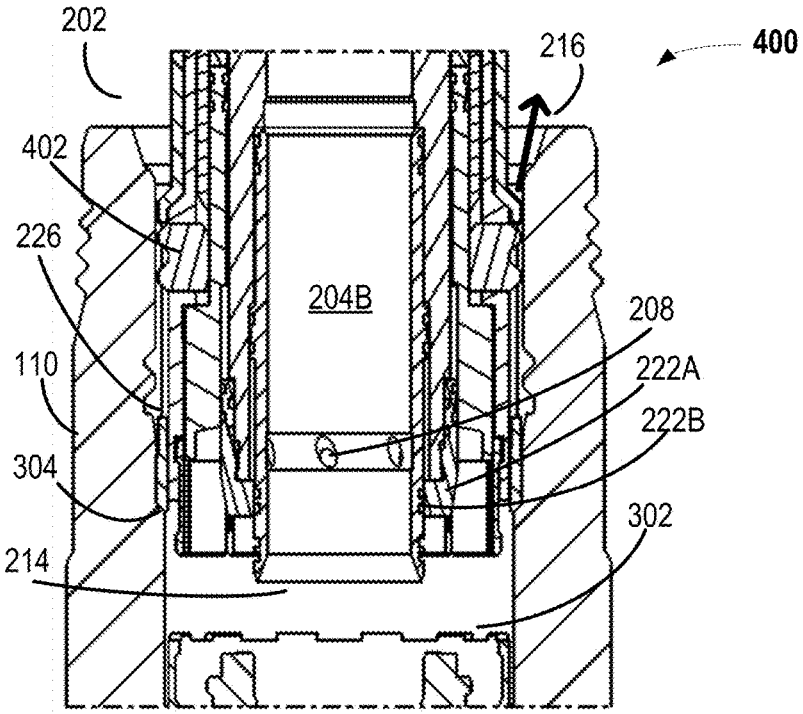
FIGS. 4A and 4B are cross-sectional views of aspects of a system for a re-entry tool with the re-entry tool landed on a shoulder of the Xmas tree head, in accordance with at least one embodiment.
Figure 4B:
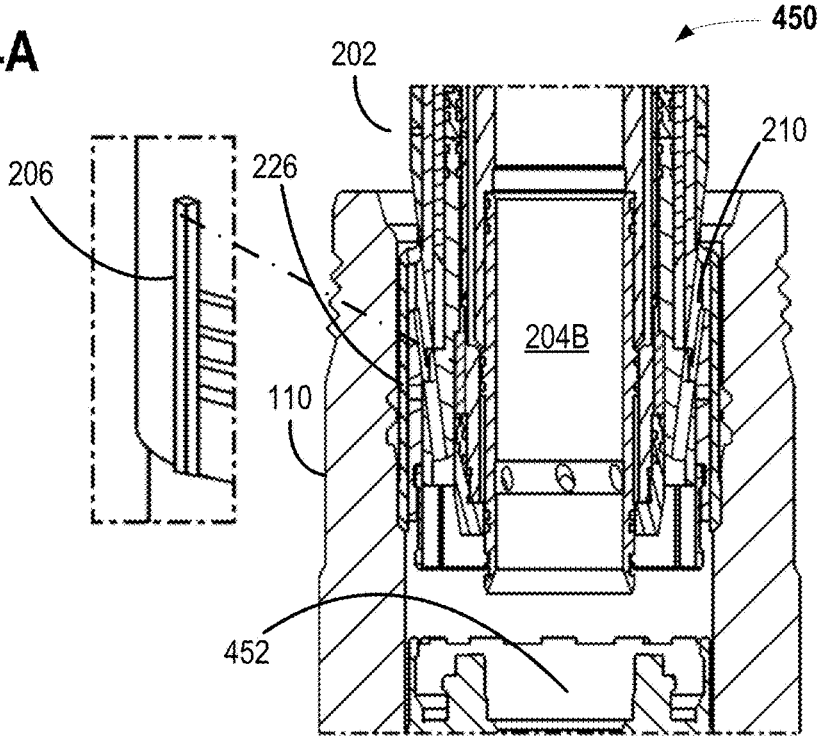

FIGS. 4A and 4B are cross-sectional views of aspects 400, 450 of a system for a re-entry tool 202 with the re-entry tool landed on a shoulder 304 of the Xmas tree head, in accordance with at least one embodiment. In at least one embodiment, FIGS. 4A and 4B illustrate a second step of the use of a system for a re-entry tool 202 with the Xmas tree head 110. Further, FIG. 4A illustrates its cross-sectional view conducted at a cross-section taken at one or more dogs 402, whereas FIG. 4B illustrates its cross-sectional view conducted at a cross-section taken at a flushing hole 208. As the flushing hole 208 may be behind the dogs 402, the cross-sectional view of FIG. 4B does not illustrate the dogs 402. The flushing operation continues during this step with debris on the latching profile 302 removed through the flushing slots 210. As the stinger 204B is in a retracted position, the flushing holes 208 may be partly blocked and most of the fluid flow is from the bottom 214 of the stringer 204B of the flushing tool. This at least allows flushing of an internal portion 452 of a latching profile 302.

Figure 5A:
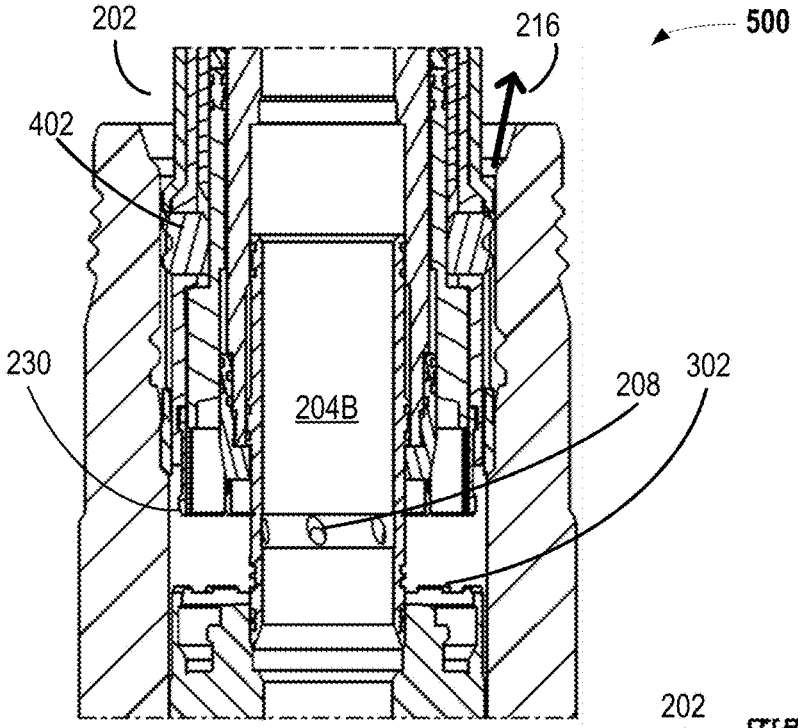
FIGS. 5A and 5B are cross-sectional views of aspects of a system for a re-entry tool with a stinger of the re-entry tool extended into latching profile of an Xmas tree head, in accordance with at least one embodiment.
Figure 5B:
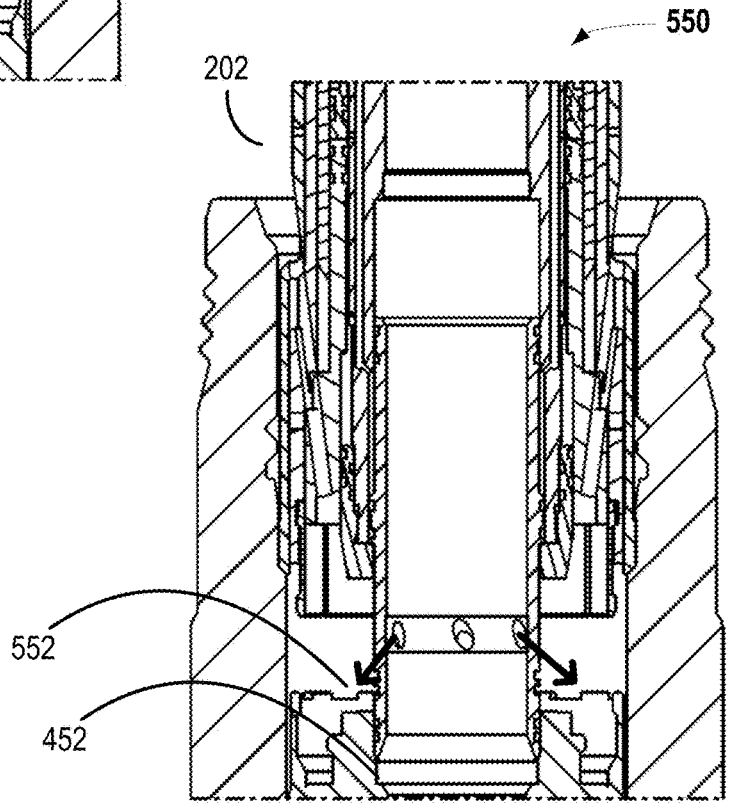

FIGS. 5A and 5B are cross-sectional views of aspects 500, 550 of a system for a re-entry tool 202 with a stinger 204B of the re-entry tool in an extended position, into latching profile 302 of an Xmas tree head, in accordance with at least one embodiment. In at least one embodiment, FIGS. 5A and 5B illustrate a third step of the use of a system for a re-entry tool 202 with the Xmas tree head 110. Further, FIG. 5A illustrates its cross-sectional view conducted at a cross-section taken at one or more dogs 402, whereas FIG. 5B illustrates its cross-sectional view conducted at a cross-section taken at a flushing hole 208. In at least one embodiment, as the flushing operation progresses from the first to the second steps, the fluid returned to an external environment 216 is studied to ensure that debris is seen returning with the fluid. In the third step, after the returning fluid is sufficiently clear of debris or together with the removal of debris, the stinger 204B is moved to an extended position, as illustrated. This may be performed by pressure applied to the stinger through the re-entry tool 202 to break or disassociate from provided retention tabs 222B between a stinger retainer cap 222A and the stinger 204B. Further, as the stinger is within the interior portion 452 of the latching profile 302, in the third step, the fluid flushing targets debris an outer portion 552 of the latching profile 302 using the flushing holes 208 that are fully open. FIG. 5A also illustrates the latch dogs 230 from FIG. 2 which may be provided as an independent feature or as one of the one or more sleeves may pivot radially. The latch dogs 230 enable latching of the re-entry tool 202 with the latching profile 302 (in FIG. 3) of a tubing hanger 104 or of the Xmas tree head 110, as described with respect to one or more of the subsequent FIGS. herein.

Figure 6A:
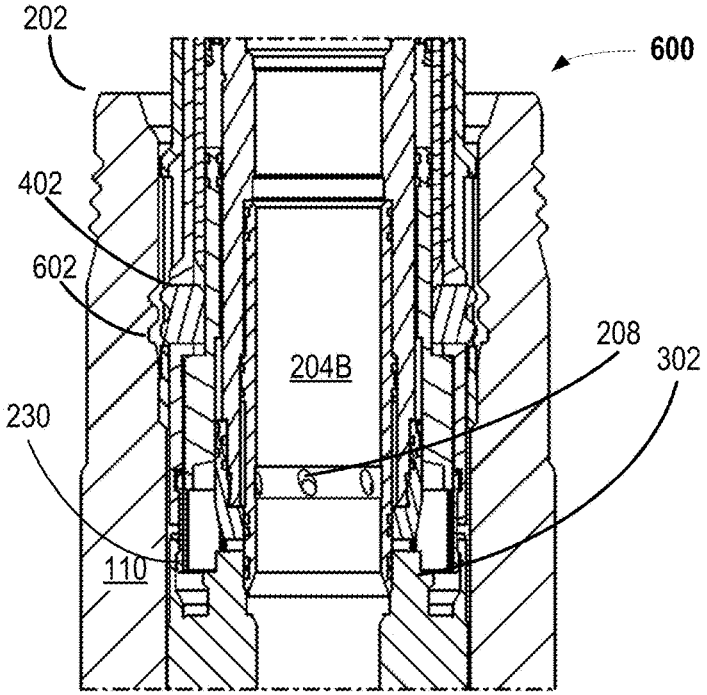
FIGS. 6A and 6B are cross-sectional views of aspects of a system for a re-entry tool with re-entry tool landed on a latching profile of an Xmas tree head, in accordance with at least one embodiment.
Figure 6B:
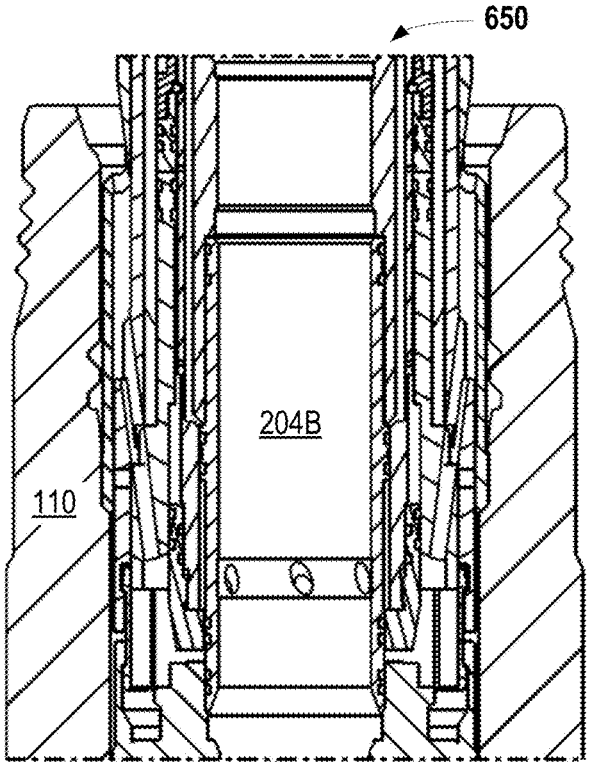

FIGS. 6A and 6B are cross-sectional views of aspects 600, 650 of a system for a re-entry tool with re-entry tool landed on a latching profile of an Xmas tree head, in accordance with at least one embodiment. In at least one embodiment, FIGS. 6A and 6B illustrate a fourth step of the use of a system for a re-entry tool 202 with the Xmas tree head 110. Further, FIG. 6A illustrates its cross-sectional view conducted at a cross-section taken at one or more dogs 402, whereas FIG. 6B illustrates its cross-sectional view conducted at a cross-section taken at a flushing hole 208. In at least one embodiment, with the debris removed via the first to the third steps, re-entry tool 202 is allowed to drop further into the Xmas tree head 110 till the one or more dogs 402 matches with provided dog profile 602 provided on an inner diameter (ID) of the Xmas tree head 110. For example, the re-entry tool 202 may drop into the outer portion 552 of the latching profile 302. In at least one embodiment, the dropping of the re-entry tool 202 causes the stinger 204B to retract. In at least one embodiment, in the fourth step, there may be a venting of the soft land sleeve 226 to allow the re-entry tool 202 to drop into the outer portion 552 of the latching profile 602. FIG. 6A also illustrates the latch dogs 230 from FIG. 5A may be radially latched with the latching profile 302 of a tubing hanger 104 or of the Xmas tree head 110.

Figure 7A:
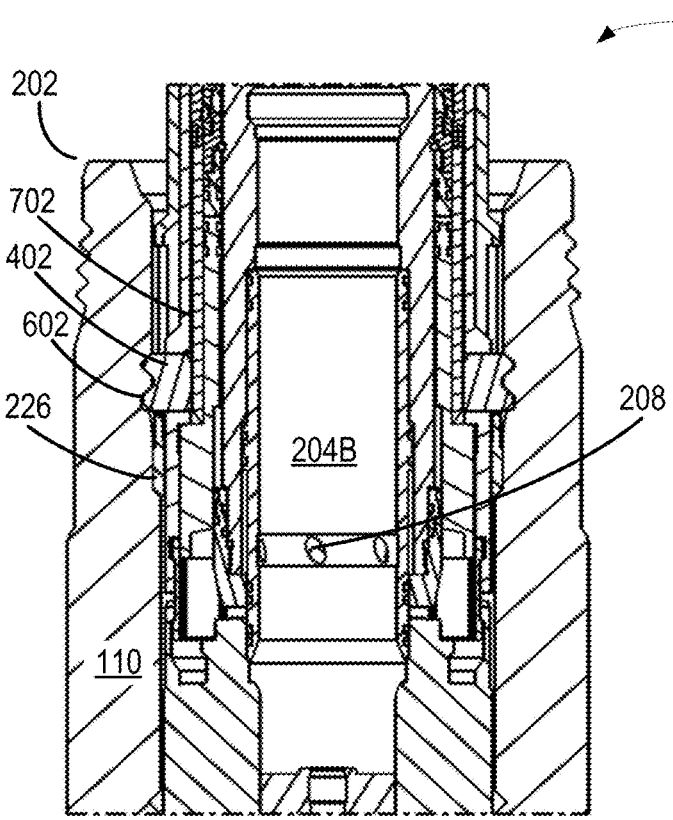
FIGS. 7A and 7B are cross-sectional views of aspects of a system for a re-entry tool with dogs of a re-entry tool engaged with an Xmas tree head, in accordance with at least one embodiment.
Figure 7B:
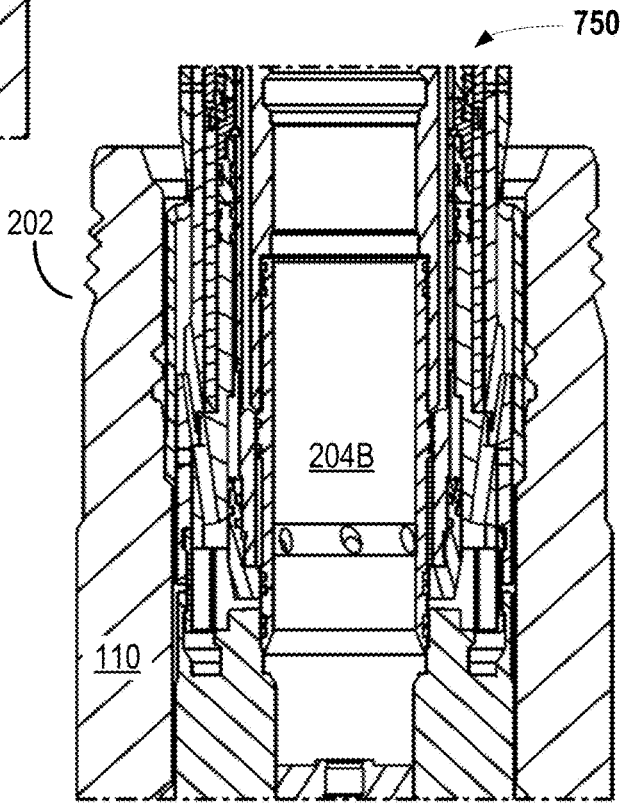

FIGS. 7A and 7B are cross-sectional views of aspects 700, 750 of a system for a re-entry tool with dogs 402 of a re-entry tool 202 engaged with an Xmas tree head 110, in accordance with at least one embodiment. In at least one embodiment, FIGS. 7A and 7B illustrate a fifth step of the use of a system for a re-entry tool 202 with the Xmas tree head 110. Further, FIG. 7A illustrates its cross-sectional view conducted at a cross-section taken at one or more dogs 402, whereas FIG. 7B illustrates its cross-sectional view conducted at a cross-section taken at a flushing hole 208. In at least one embodiment, with the re-entry tool 202 dropped into the outer portion 552 of the latching profile 302, the dogs 402 may be extended using a first or an outer latch piston 702 that moves to an extended position to push the dogs 402 into the dog profiles 602, which locks the re-entry tool 202 into Xmas tree head 110. In the fifth step, overpull and pressure tests of the system or the string may be performed. Further, wireline operations can begin at this step as well.

Figure 8A:
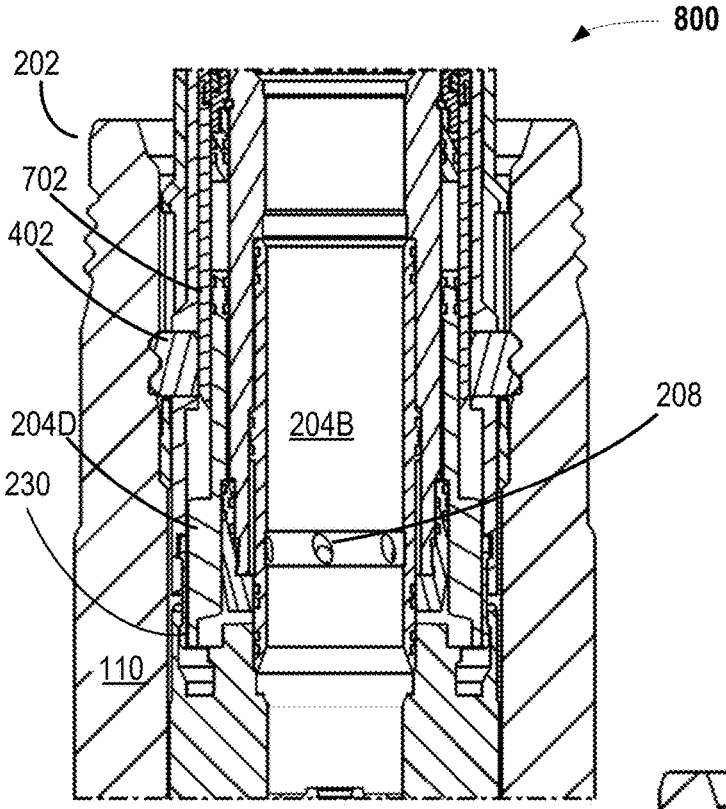
FIGS. 8A and 8B are cross-sectional views of aspects of a system for a re-entry tool with an outer latch piston in an extended position, in accordance with at least one embodiment.
Figure 8B:
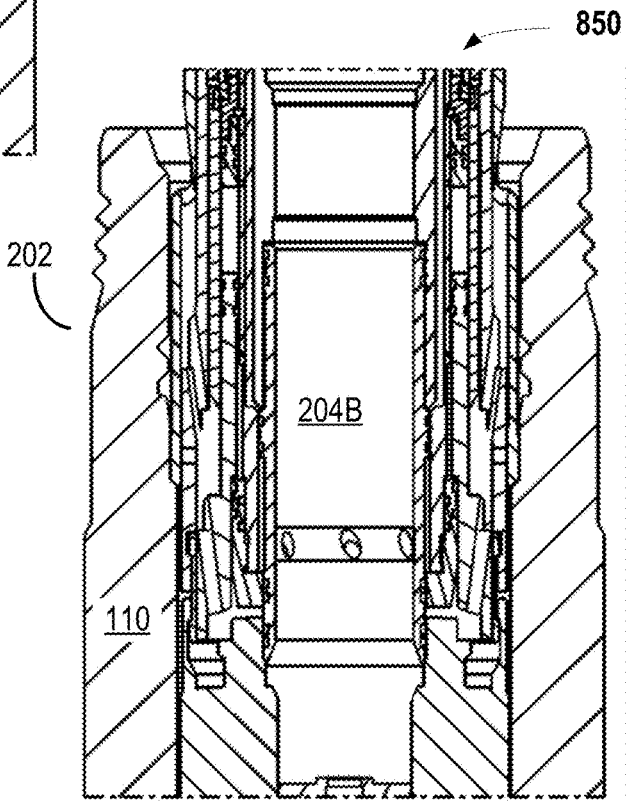

FIGS. 8A and 8B are cross-sectional views of aspects 800, 850 of a system for a re-entry tool with a first or an outer latch piston 702 in an extended position, in accordance with at least one embodiment. In at least one embodiment, FIGS. 8A and 8B illustrate a sixth step of the use of a system for a re-entry tool 202 with the Xmas tree head 110. Further, FIG. 8A illustrates its cross-sectional view conducted at a cross-section taken at one or more dogs 402, whereas FIG. 8B illustrates its cross-sectional view conducted at a cross-section taken at a flushing hole 208. In at least one embodiment, with the re-entry tool 202 locked into Xmas tree head 110, the sixth step is directed to recovery of the re-entry tool 202. For the recover, in the sixth step, a second or an inner latch piston 204D may be moved from a retracted position, as illustrated in at least FIGS. 7A and 7B, to an extended position as illustrated in FIGS. 8A and 8B. In the extended position, the second or inner latch piston 204D enables an unbalanced load in the re-entry tool 202. The unbalanced load is further to allow, at least in part, retraction of the re-entry tool 202. For example, in the extended position of the second latch piston 204D, the first latch piston 702 may be moved to a retracted position. FIG. 8A also illustrates the latch dogs 230 from FIG. 5A is radially latched with the latching profile 302 of a tubing hanger 104 or of the Xmas tree head 110, but also that the second or inner latch piston 204D prevents release of the latch dogs 230 from the latching profile 302 till the second or inner latch piston 204D is removed.

Figure 9A:
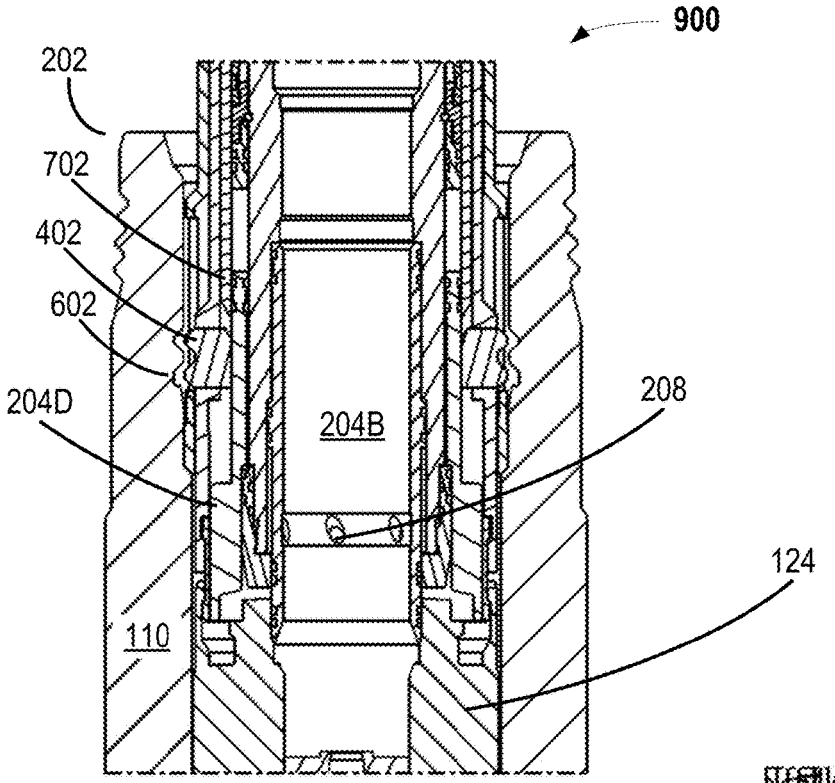
FIGS. 9A and 9B are cross-sectional views of aspects of a system for a re-entry tool with an inner latch piston in a retracted position, in accordance with at least one embodiment.
Figure 9B:
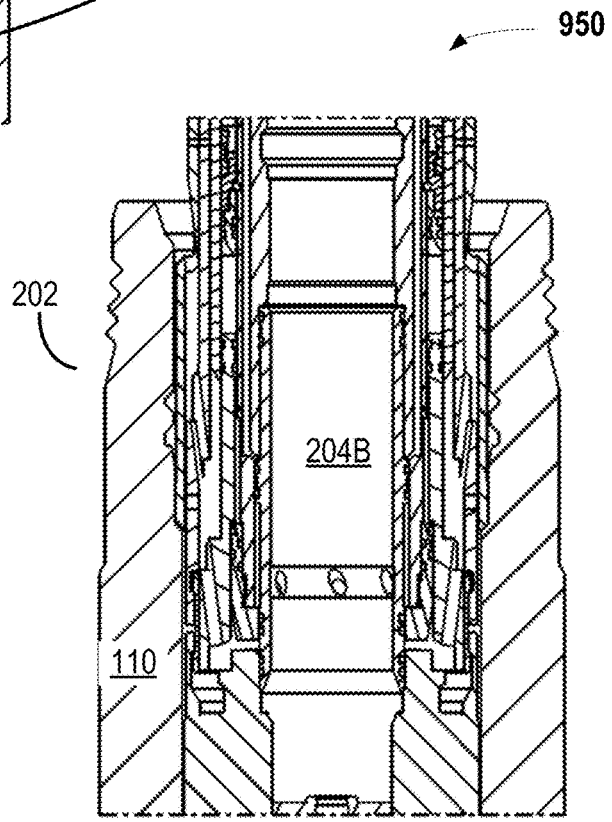

FIGS. 9A and 9B are cross-sectional views of aspects of a system for a re-entry tool with a first or inner latch piston 702 in a retracted position, in accordance with at least one embodiment. In at least one embodiment, FIGS. 9A and 9B illustrate a seventh step of the use of a system for a re-entry tool 202 with the Xmas tree head 110. Further, FIG. 9A illustrates its cross-sectional view conducted at a cross-section taken at one or more dogs 402, whereas FIG. 9B illustrates its cross-sectional view conducted at a cross-section taken at a flushing hole 208. In at least one embodiment, with the first or inner latch piston 702 moved to a retracted position, the dogs 402 may be released from the dog profiles 602. Further, pressure is maintained in the second or outer latch piston 204D so that it remains in the extended position. Tension is applied to pull on the string associated with the re-entry tool 202. This causes an unlock of the re-entry tool 202 from the Xmas tree head 110 (such as, at an actuation sleeve of the one or more sleeves). The re-entry tool 202 can be recovered to a surface following the unlock performed.

In at least one embodiment, FIG. 9A also illustrates that the second or outer latch piston 204D can remain in the extended position if the re-entry tool 202 is to be used to remove the tubing hanger 124. Otherwise, the second or outer latch piston 204D can remain retracted up for cleaning and for other operations, including for running through the stinger 204B. For example, in FIGS. 7A and 7B, illustrating a fifth step of the use of a system for a re-entry tool 202, the second or outer latch piston 204D remains retracted and this position can be maintained during cleaning and other operations. However, FIGS. 8A and 8B, illustrating a sixth step of the use of a system for a re-entry tool 202, illustrates that the second or outer latch piston 204D is extended to allow removal of the tubing hanger 124. Further, the first or inner latch piston 702 is retracted, as in FIG. 8A, so that the dogs 402 are retracted and the re-entry tool 202 can be removed.

Figure 10A:
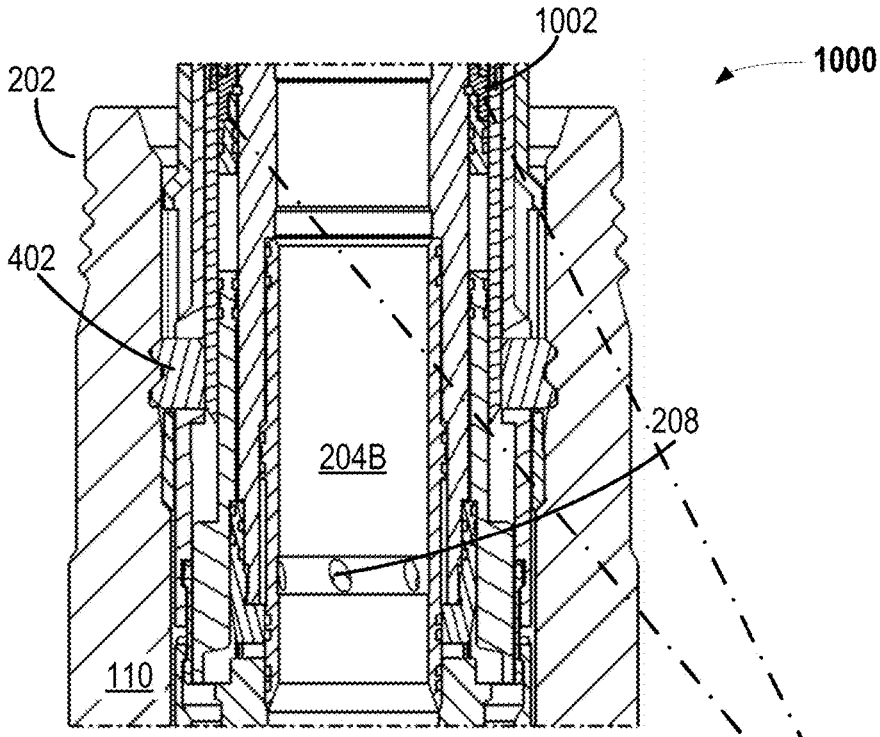
FIGS. 10A and 10B are cross-sectional views of aspects of a system for a re-entry tool with one or more break rings in an unbroken status and in a broken status, in accordance with at least one embodiment.
Figure 10B:
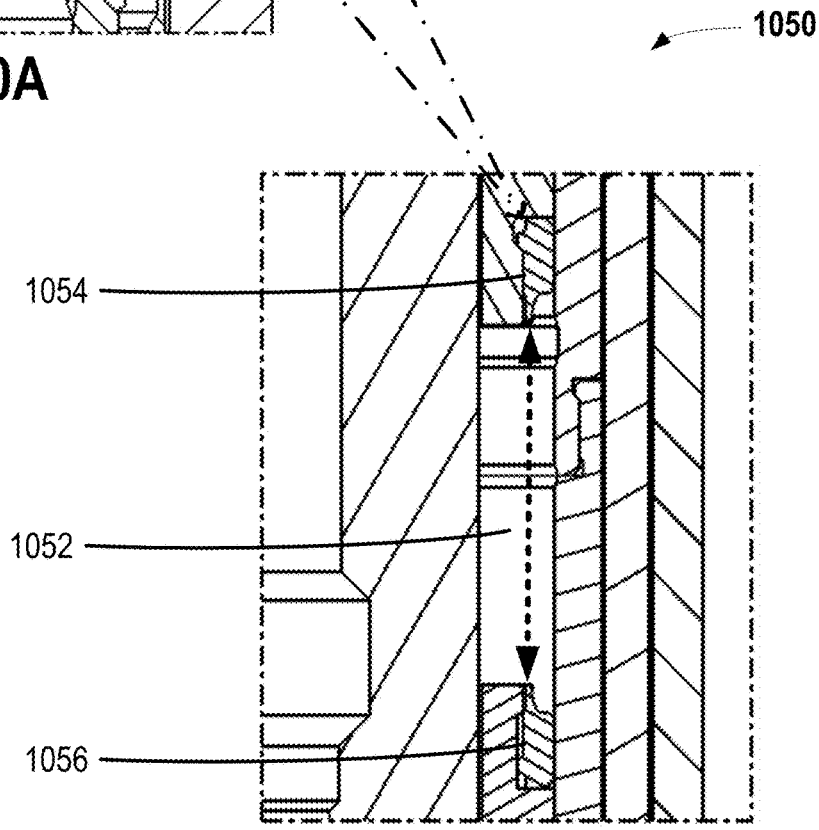

FIGS. 10A and 10B are cross-sectional views of aspects 1000, 1050 of a system for a re-entry tool with one or more break rings 1002 in an unbroken status and in a broken status 1052, in accordance with at least one embodiment. In at least one embodiment, the aspects 1000, 1050 are associated with an emergency operation of the re-entry tool. In the emergency operation, a blowout preventer (BOP) associated with the Xmas tree head 110 is first closed. Further, provided vent areas 234 (in FIG. 2) of the system may be vented, in part, by extending a further latch piston 236. This causes one or more break rings 1002 to be in a broken status 1052 from an unbroken status 1002.

In at least one embodiment, with the one or more break rings 1002 in the broken status 1052, annular tension may be applied from below the system to force the first or outer latch piston 204D to back up into the re-entry tool 202. In at least one embodiment, the annular tension is from an annular pressure that, in turn, causes or generates an unbalanced load on the first or outer latch piston 204D. This causes the outer latch piston 204D to retract and allows retrieval of the re-entry tool 202.

Figure 11:
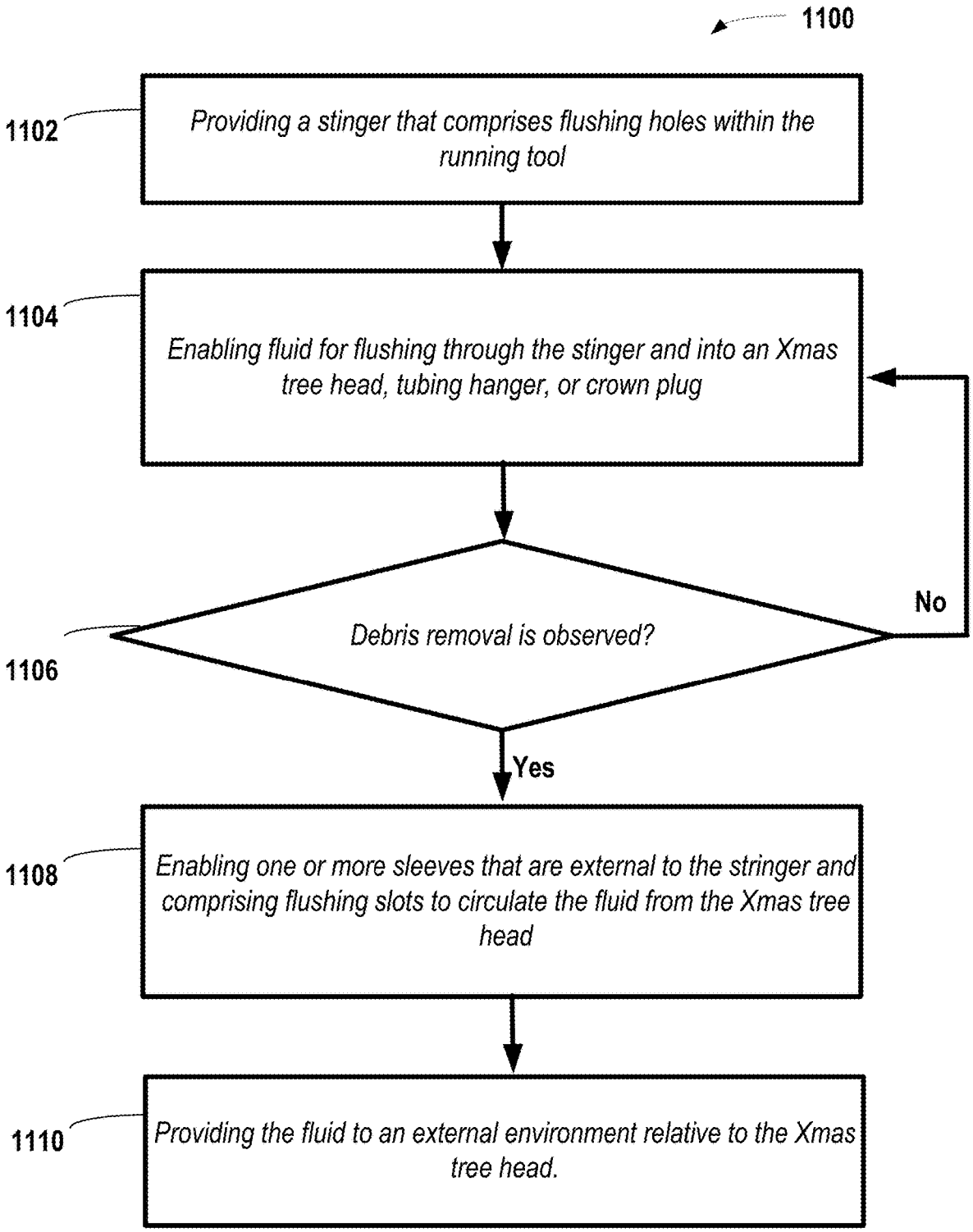
FIG. 11 is a flow diagram of a method to be used with a system for a re-entry tool that is described at least in FIGS. 1-10B herein, in accordance with at least one embodiment.

FIG. 11 is a flow diagram of a method 1100 for a slip hanger or a packoff to be used with an oilfield equipment that is described at least in FIGS. 1-10B herein, in accordance with at least one embodiment. The method 1100 includes providing (1102) a stinger that has flushing holes within the re-entry tool. The method also includes enabling (1104) fluid for flushing through the stinger and into an Xmas tree head. Verification (1106) may be performed for debris in the fluid to confirm that debris is being removed and to determine when the next step should proceed. For example, a visually clear return of fluid with lesser or no debris observed will allow commencement of the subsequent steps using the re-entry tool.

In at least one embodiment, the method 110 includes enabling (1108) one or more sleeves that are external to the stringer and that include flushing slots to return the fluid from the Xmas tree wellhead. A further step 1110 may be part of the removal step or may be distinctly provided to enable the removal in step 1108 to occur so that fluid is removed to an external environment relative to the Xmas tree head.

In at least one embodiment, the method 1100 may include a further step or a sub-step in which the stinger is capable of being in one or more of an extended position or a retracted position relative to the re-entry tool. This step may be by arrangement of one or more sleeves together using orientation keys prior to deployment of the re-entry tool. Therefore, in at least one embodiment, the method 1100 may include a further step or a sub-step for enabling, using one or more orientation keys, alignment of each of the one or more sleeves with respect to each other and with respect to the stinger within the re-entry tool.

In at least one embodiment, the method 1100 may include a further step or a sub-step of extending provided dogs through at least one of the one or more sleeves. In at least one embodiment, the method 1100 may include a further step or a sub-step of causing the provided dogs to engage the Xmas tree head to provide a locking of the re-entry tool with respect to the Xmas tree head. In at least one embodiment, the method 1100 may include a further step or a sub-step for providing a shoulder of the Xmas tree head and a surface of the re-entry tool. This may be performed at manufacture or by orientation of components in the system so that the shoulder provided is used for interfacing between components of the system herein. In at least one embodiment, the method 1100 may include a further step or a sub-step for landing the re-entry tool on the Xmas tree head at an interface of the shoulder and the surface. In at least one embodiment, the method 1100 may include a further step or a sub-step for enabling the flushing through the re-entry tool and into an Xmas tree head to occur prior to the landing, during the landing, and after the landing.

In at least one embodiment, the method 1100 may include a further step or a sub-step for allowing, using a stinger retainer cap, the stinger to be retained in a retracted position relative to the re-entry tool. In at least one embodiment, the method 1100 may include a further step or a sub-step for allowing the stringer to move to an extended position relative to the re-entry tool.

In at least one embodiment, the method 1100 may include a further step or a sub-step for allowing the stinger, in an extended position, to be received into a latching profile of the Xmas tree head. In at least one embodiment, the method 1100 may include a further step or a sub-step allowing landing of the re-entry tool on the latching profile of the Xmas tree head. The stinger can be moved from the extended position to a retracted position during the landing.

In at least one embodiment, the method 1100 may include a further step or a sub-step for enabling a first latch piston to be movable within the one or more sleeves. In at least one embodiment, the method 1100 may include a further step or a sub-step for causing, using the first latch piston, engagement or disengagement of provided dogs with respect to the Xmas tree head. Further, the engagement of the provided dogs, with respect to the Xmas tree head, enables overpull, pressure testing, and wireline operations using the re-entry tool. Further, disengagement of the provided dogs allows, at least in part, retraction of the re-entry tool.

In at least one embodiment, the method 1100 may include a further step or a sub-step for enabling a second latch piston of the one or more sleeves to be in one of a retracted position or an extended position. Further, in at least one embodiment, the method 1100 may include a step or a sub-step for enabling, in the extended position of the second latch piston, an unbalanced load in the re-entry tool to allow, at least in part, retraction of the re-entry tool.

In at least one embodiment, the method 1100 may include a further step or a sub-step for enabling one or more break rings within the one or more sleeves to be an unbroken status in normal operations of the re-entry tool. However, the method 1100 may include a further step or a sub-step for causing the one or more break rings to be in a broken status during an emergency operation in the re-entry tool. This then allows, in the broken status of the one or more break ring, a latch piston of the one or more sleeves to be in an extended position from a retracted position. Further, the extended position enables an unbalanced load in the re-entry tool and allows, at least in part as a result of the unbalanced load, retraction of the re-entry tool.

While techniques herein may be subject to modifications and alternative constructions, these variations are within spirit of present disclosure. As such, certain illustrated embodiments are shown in drawings and have been described above in detail, but these are not limiting disclosure to specific form or forms disclosed; and instead, cover all modifications, alternative constructions, and equivalents falling within spirit and scope of disclosure, as defined in appended claims.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Recitation of ranges of values herein are merely intended to serve as a shorthand method of referring individually to each separate value falling within range, unless otherwise indicated herein and each separate value is incorporated into specification as if it were individually recited herein. In at least one embodiment, use of a term, such as a set (for a set of items) or subset unless otherwise noted or contradicted by context, is understood to be nonempty collection including one or more members. Further, unless otherwise noted or contradicted by context, term subset of a corresponding set does not necessarily denote a proper subset of corresponding set, but subset and corresponding set may be equal.

Conjunctive language, such as phrases of form, at least one of A, B, and C, or at least one of A, B and C, unless specifically stated otherwise or otherwise clearly contradicted by context, is otherwise understood with context as used in general to present that an item, term, etc., may be either A or B or C, or any nonempty subset of set of A and B and C. In at least one embodiment of a set having three members, conjunctive phrases, such as at least one of A, B, and C and at least one of A, B and C refer to any of following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, terms such as plurality, indicates a state of being plural (such as, a plurality of items indicates multiple items). In at least one embodiment, a number of items in a plurality is at least two but can be more when so indicated either explicitly or by context. Further, unless stated otherwise or otherwise clear from context, phrases such as based on means based at least in part on and not based solely on.

In at least one embodiment, even though the above discussion provides at least one embodiment having implementations of described techniques, other architectures may be used to implement described functionality, and are intended to be within scope of this disclosure. In addition, although specific responsibilities may be distributed to components and processes, they are defined above for purposes of discussion, and various functions and responsibilities might be distributed and divided in different ways, depending on circumstances.

In at least one embodiment, although subject matter has been described in language specific to structures and/or methods or processes, it is to be understood that subject matter claimed in appended claims is not limited to specific structures or methods described. Instead, specific structures or methods are disclosed as example forms of how a claim may be implemented.

From all the above, a person of ordinary skill would readily understand that the tool of the present disclosure provides numerous technical and commercial advantages and can be used in a variety of applications. Various embodiments may be combined or modified based in part on the present disclosure, which is readily understood to support such combination and modifications to achieve the benefits described above.

It should be appreciated that embodiments herein may utilize one or more values that may be experimentally determined or correlated to certain performance characteristics based on operating conditions under similar or different conditions. The present disclosure described herein, therefore, is well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art and are intended to be encompassed within the spirit of the present disclosure disclosed herein and the scope of the appended claims.

What is claimed is:

1. A system for a re-entry tool to be used with oilfield equipment, comprising:

a stinger comprising flushing holes to enable fluid for flushing through the re-entry tool and into one or more of an Xmas tree head, tubing hanger, or crown plug;

one or more sleeves external to the stinger and comprising flushing slots to enable circulation of the fluid from the Xmas tree head, tubing hanger, or crown plug to an external environment relative to the Xmas tree head, tubing hanger, or crown plug; and one or more orientation keys to enable alignment of each of the one or more sleeves with respect to each other and with respect to the stinger within the re-entry tool.

2. The system of claim 1, wherein the stinger is capable of being in one or more of an extended position or a retracted position relative to the re-entry tool.

3. The system of claim 1, further comprising:

a plurality of dogs extending through at least one of the one or more sleeves, the plurality of dogs to engage the Xmas tree head to provide a locking of the re-entry tool with respect to the Xmas tree head.

4. The system of claim 1, further comprising:

a shoulder of the Xmas tree head; and a surface of the re-entry tool, the surface to enable landing the re-entry tool on the shoulder during the flushing through the re-entry tool and into an Xmas tree head.

5. The system of claim 1, further comprising:

a stinger retainer cap to allow the stinger to be retained in a retracted position relative to the re-entry tool and to allow the stringer to move to an extended position relative to the re-entry tool.

6. The system of claim 1, further comprising:

a latching profile of the Xmas tree head to allow receipt of the stinger in an extended position and to allow landing of the re-entry tool thereon.

7. The system of claim 1, further comprising:

a first latch piston of the one or more sleeves, the first latch piston to cause engagement or disengagement of a plurality of dogs with respect to the Xmas tree head, wherein the engagement of the plurality of dogs with respect to the Xmas tree head enables overpull, pressure testing, and wireline operations using the re-entry tool, and wherein disengagement of the plurality of dogs allows, at least in part, retraction of the re-entry tool.

8. The system of claim 1, further comprising:

a second latch piston of the one or more sleeves, the second latch piston to be in one of a retracted position or an extended position, wherein the retracted position enables an unbalanced load in the re-entry tool to allow, at least in part, retraction of the re-entry tool, wherein the extended position allows removal of the tubing hanger from the Xmas tree head.

9. The system of claim 1, further comprising:

one or more break rings within the one or more sleeves, the one or more break rings to be an unbroken status in normal operations of the re-entry tool and to be in a broken status during an emergency operation in the re-entry tool, the broken status to allow for an unbalanced load on a latch piston to further allow, at least in part, retraction of the re-entry tool.

10. A method for a re-entry tool to be used with oilfield equipment, comprising:

providing a stinger that comprises flushing holes within the re-entry tool;

enabling fluid for flushing through the stinger and into one or more of an Xmas tree head, tubing hanger, or crown plug;

enabling one or more sleeves that are external to the stringer and comprising flushing slots to circulate the fluid from the Xmas tree head, tubing hanger, or crown plug to an external environment relative to the Xmas tree head; and enabling, using one or more orientation keys, alignment of each of the one or more sleeves with respect to each other and with respect to the stinger within the re-entry tool.

11. The method of claim 10, wherein the stinger is capable of being in one or more of an extended position or a retracted position relative to the re-entry tool.

12. The method of claim 10, further comprising:

extending a plurality of dogs through at least one of the one or more sleeves; and causing the plurality of dogs to engage the Xmas tree head to provide a locking of the reentry tool with respect to the Xmas tree head.

13. The method of claim 10, further comprising:

providing a shoulder of the Xmas tree head and a surface of the re-entry tool;

landing the re-entry tool on the Xmas tree head at an interface of the shoulder and the surface;

enabling the flushing through the re-entry tool and into an Xmas tree head prior to the landing, during the landing, and after the landing.

14. The method of claim 10, further comprising:

allowing, using a stinger retainer cap, the stinger to be retained in a retracted position relative to the re-entry tool; and allowing the stringer to move to an extended position relative to the re-entry tool.

15. The method of claim 10, further comprising:

allowing the stinger, in an extended position, to be received into a latching profile of the Xmas tree head; and allowing landing of the re-entry tool on the latching profile of the Xmas tree head, wherein the stinger is moved from the extended position to a retracted position during the landing.

16. The method of claim 10, further comprising:

enabling a first latch piston to be movable within the one or more sleeves; and causing, using the first latch piston, engagement or disengagement of a plurality of dogs with respect to the Xmas tree head, wherein the engagement of the plurality of dogs with respect to the Xmas tree head enables overpull, pressure testing, and wireline operations using the reentry tool, and wherein disengagement of the plurality of dogs allows, at least in part, retraction of the re-entry tool.

17. The method of claim 10, further comprising:

enabling a second latch piston of the one or more sleeves to be in one of a retracted position or an extended position;

enabling, in the retracted position of the second latch piston, an unbalanced load in the reentry tool to allow, at least in part, retraction of the re-entry tool; and enabling, in the extended position of the of the second latch piston, removal of the tubing hanger from the Xmas tree head.

18. The method of claim 10, further comprising:

enabling one or more break rings within the one or more sleeves to be an unbroken status in normal operations of the re-entry tool;

causing the one or more break rings to be in a broken status during an emergency operation in the re-entry tool; and allowing, in the broken status of the one or more break ring, retraction of the re-entry tool.

* * * * *